United States Patent [19]

Erickson

[11] Patent Number: 5,041,808

[45] Date of Patent: Aug. 20, 1991

[54] DOUBLE LOAD BREAK SWITCH AND CIRCUIT

[75] Inventor: John W. Erickson, Crystal Lake, Ill.

[73] Assignee: Boltswitch, Inc., Crystal Lake, Ill.

[21] Appl. No.: 614,225

[22] Filed: Nov. 16, 1990

[51] Int. Cl.[5] ..... H01H 71/20; H01H 73/24

[52] U.S. Cl. ..... 337/156; 337/143; 337/146

[58] Field of Search ..... 337/142, 143, 144, 145, 337/146, 147, 148, 149, 150, 151, 152, 153, 154, 155, 156, 157, 4

[56] References Cited

U.S. PATENT DOCUMENTS 3,213,247 10/1965 Stene .
4,110,584 8/1978 Erickson et al. .
4,177,368 12/1979 Erickson .

*Primary Examiner*—Harold Broome
*Attorney, Agent, or Firm*—Kinzer, Plyer, Dorn, McEachran & Jambor

[57] ABSTRACT

A multi-pole load break switch having two sets of contacts in each pole connected in series to isolate its fuse. Also disclosed is a circuit incorporating the switches of the invention in a double-ended switch board having two power supplies normally isolated from each other.

1 Claim, 2 Drawing Sheets

DOUBLE LOAD BREAK SWITCH AND CIRCUIT

BACKGROUND OF THE INVENTION

This invention relates to a multi-pole load break switch having two sets of ganged contacts in each pole connected in series to isolate its fuse and to a circuit incorporating said switches in doubled-ended switch boards or anywhere there may be a current backfeed.

Fused load-break, multi-pole switches are frequently used as service entrance equipment and in other relatively high current applications. When installed in hospitals or in other facilities where the continuity of electrical service is essential, a dual power supply is usually provided so that if one power main is shut down the electrical load can be handled by the other power main. In such a conventional dual source installation, each power main normally supplies its own group of branch circuits with the two power mains tied between the groups of branch circuits by a normally open fused load-break, multi-pole switch. In such a circuit, all of the fuses are normally "hot". If, for any reason, one of the power mains fails or must be shut down, its load break switch is opened and the load break switch in the tie between the power mains is closed, thereby supplying power from the other power main to both groups of branch circuits. After the closing of the load break switch in the tie, all of the fuses, including the fuse for the power main that was disconnected or shut down, remain "hot". In such circumstances an electrician must either change a fuse under "hot" conditions or, if such a procedure is considered too dangerous under the circumstances, the entire electrical service to the facility must be shut down in order to safely replace a fuse, thereby frustrating the purpose for which a dual source of power was originally provided.

Summary of the Invention

It is an object of the present invention, therefore, to provide a multi-pole, bolted pressure contact switch in which each pole has two sets of ganged contacts connected in series and isolating its fuse so that the fuse can be safely removed when the contacts are open even when the circuit in which the switch is located is energized by a backfeed of current from a dual source.

A further object of this invention is a circuit for installation in a hospital or other facility where continuity of electrical power is essential and which, to obtain this continuity, utilizes multiple sources of power to individually supply groups of branch circuits. The multiple sources of power are normally isolated from each other but can be tied together to supply the branch circuits of both sources if one source fails. The invention is particularly directed to such a system having multi-pole, bolted pressure contact switches with sets of ganged contacts connected in series so that the fuses of the switches may be isolated.

Accordingly, the invention relates to a fused high current, low voltage load break pressure contact switch. The switch has a plurality of individual phase circuits. Each phase circuit includes a first set of contacts which has a first fixed contact, a first movable contact movable between a closed position in bolted pressure contact with said first fixed contact and an open position displaced from said first fixed contact. A second set of contacts is also provided in each phase circuit in series with the first set of contacts and includes a second fixed contact, a second movable contact movable between a closed position in bolted pressure contact with said second fixed contact and an open position displaced from said second fixed contact. A fuse holder and a fuse are located in each phase circuit between said first and second sets of contacts. A switch operator mechanism having an operating lever is provided. The operating lever is connected to an operating rod, which in turn is connected to said first set of contacts. A connecting bar extends between and is attached to said first and second sets of contacts so that they can be opened and closed simultaneously upon actuation of said switch operator mechanism.

Description of the Preferred Embodiment

Figure 2:
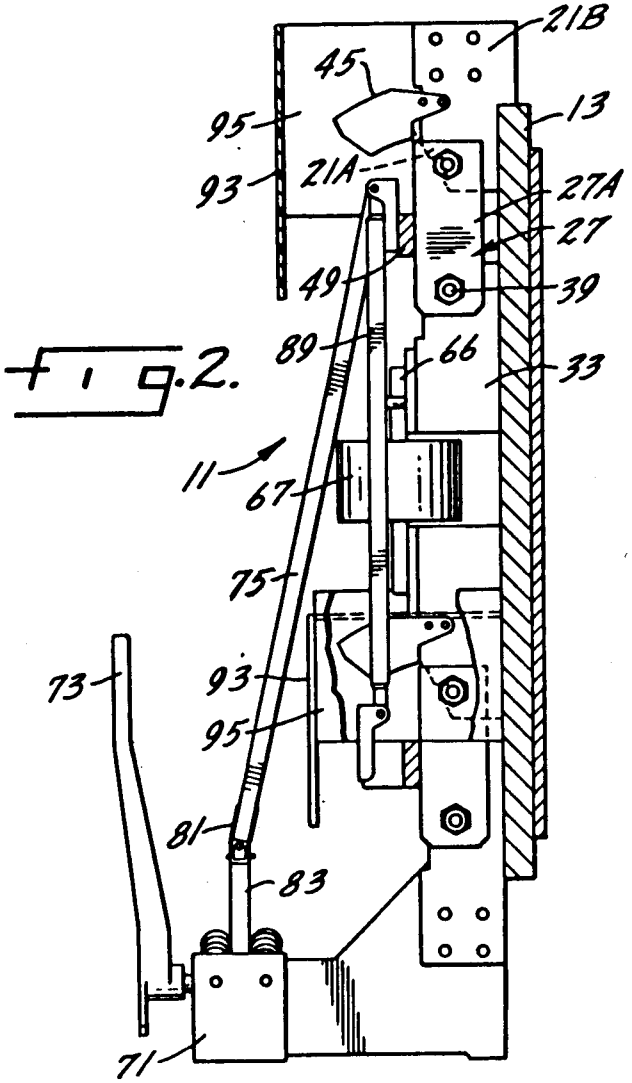
FIG. 2 is a side elevational view, in section, of the load break switch as viewed along line 2—2 of FIG. 1.
Figure 1:
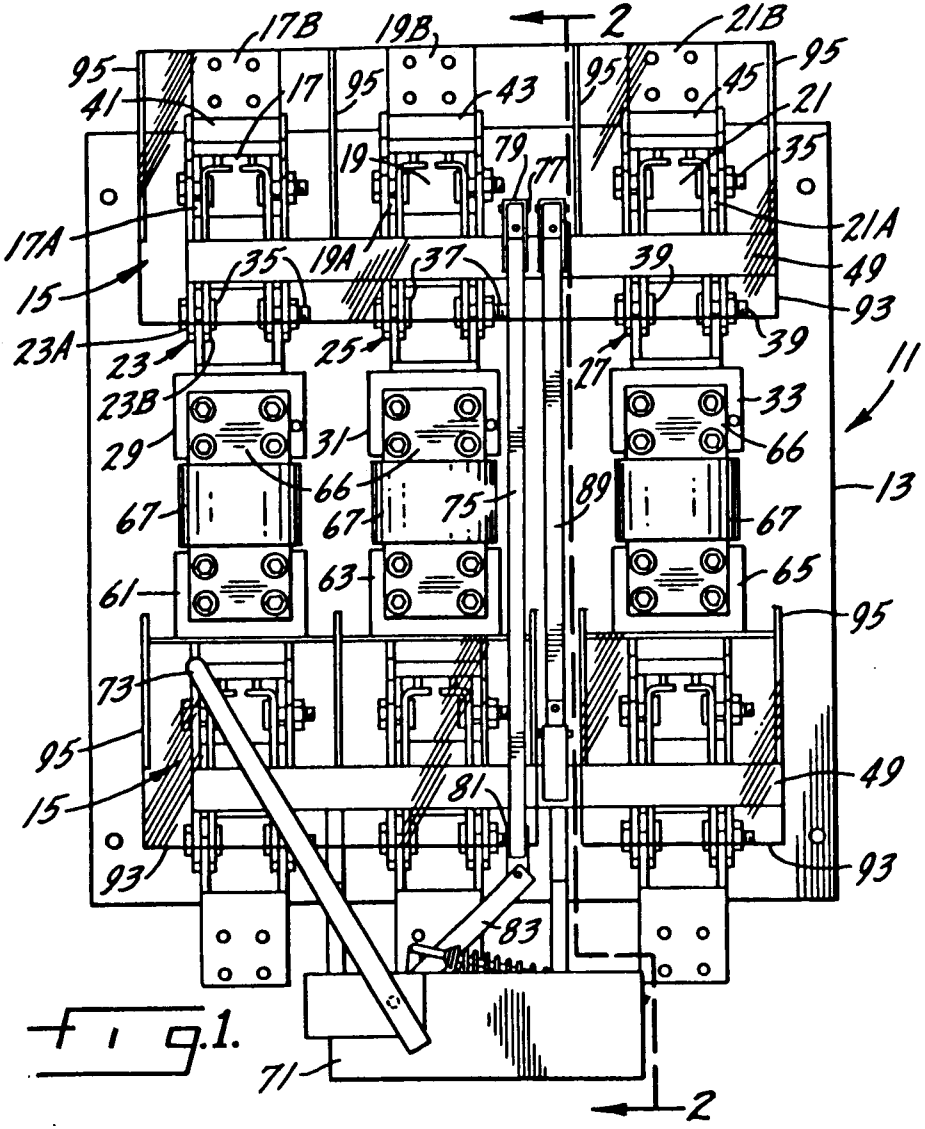
FIG. 1 is a front elevational view of a load break switch constructed in accordance with the present invention.
Figure 3:
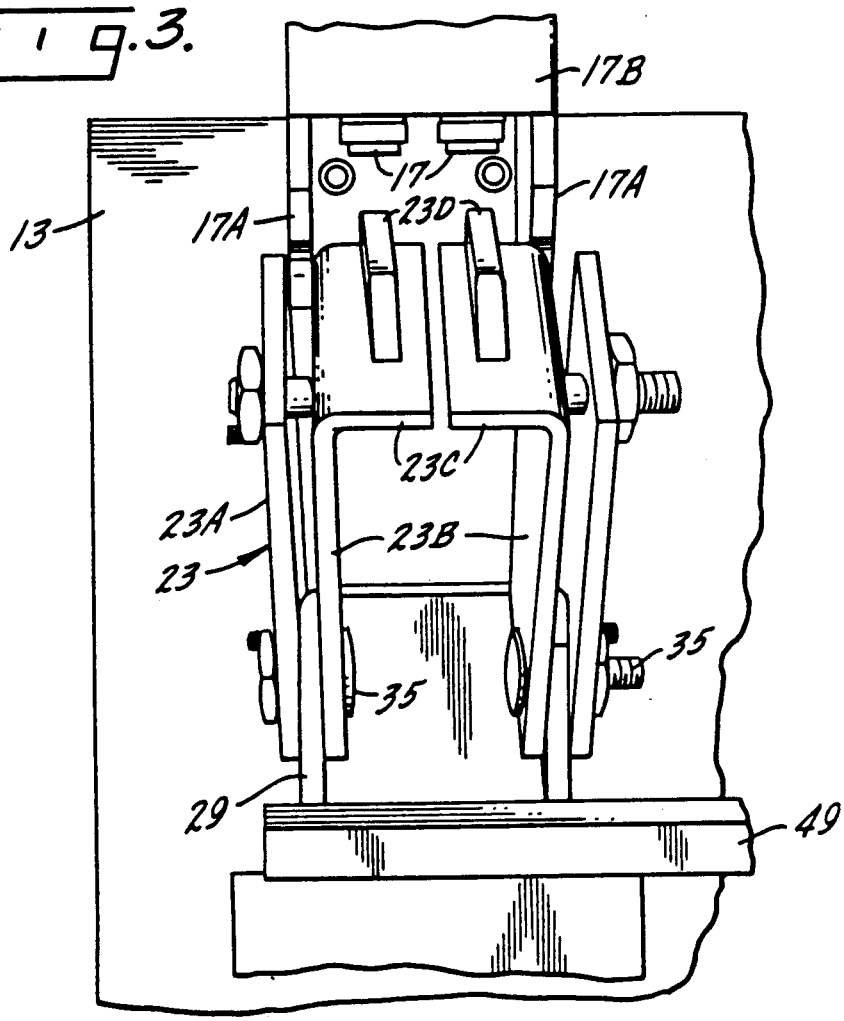
FIG. 3 is a pictorial front view, on an enlarged scale, of a set of contacts in an open position.

FIGS. 1 and 2 of the drawings illustrate a high current, low voltage load break switch 11 which is mounted on a base member 13 of insulating material. A switch of this type is normally installed in a metal housing for safety and security reasons, but such a housing has been omitted from the drawings and description for clarity of illustration and explanation. Each load break switch 11 includes two sets of contacts connected in series. The first set of contacts 15 includes fixed contacts 17, 19 and 21 mounted across the top of the insulating base 13. The fixed contacts are provided with outwardly-projecting contact blades 17A, 19A and 21A, respectively, with each fixed contact being provided with an individual line connection terminal lug 17B, 19B and 21B, respectively. Each of the fixed contacts 17, 19 and 21 is one element of a pole of the switch 11. Contacts 17, 19 and 21 are each engageable by a respective one of three movable contacts 23, 25 and 27. Each movable contact comprises two pairs of contact blades, such as the blades 23A and 23B of the movable contact 23, shown by way of example in enlarged detail in FIG. 3 of the drawings. The outer blade 23A is straight and the blade 23B of each pair is L-shaped and has a leg 23C that extends inwardly toward the other pair of blades. An arc tip 23D is mounted on each leg 23C. Movable contacts 23, 25 and 27 are pivotally mounted upon electrical connector brackets 29, 31 and 33, respectively, by means of suitable pivot members 35, 37 and 39, respectively. Three arc chutes 41, 43 and 45 are mounted on the pairs of fixed contacts 17, 19 and 21, respectively. A suitable arc chute is shown in U.S. Pat. No. 3,441,699, but the invention should not be limited to the use of the particular construction shown in that patent, which is merely illustrative of one of a number of different forms of arc chutes which may be used.

Switch 11 further includes an actuating bar 49 that extends transversely of the switch and is connected to each of the movable contacts 23, 25 and 27 by means of a connecting linkage so that pivotal movement of the bar 49, with respect to the aligned pivot members, drives the movable contacts of the switch to move pivotally in and out of engagement with the pairs of fixed contacts 17, 19 and 21.

A second set of load break contacts 15 are mounted on the base 13 of insulating material and are identical to the first set of contacts 15 except that instead of lugs 17B, 19B and 21B, respectively, at the upper ends thereof, they are equipped with electrical connectors 61, 63 and 65, respectively. Forming a circuit between the electrical connectors 29, 31, 33 of the first set of contacts 15 and the electrical connectors 61, 63, 65, respectively, of the second set of contacts 15 are fuse holders 66 which receive fuses 67.

A switch operator mechanism 71 is provided. This mechanism may be of the type that is manually or motor operated or may be of the trip-free type described and claimed in U.S. Pat. No. 3,582,595. The switch operator mechanism 71 which is shown is equipped with an over-center spring drive which is actuated when rotation of the main drive shaft is initiated in either the switch-opening or switch-closing direction. Initial rotation of the main drive shaft in the switch-opening direction is accomplished by a switch-opening, energy-storing spring which is charged during closing motion of the switch. A manually operated handle 73 is provided to initiate actuation of the switch operator mechanism. The actuating bar 49 of upper switch 11 is connected to an operating rod 75 by means of a pivotal connection 77. More specifically, the operating rod 75 has its upper end connected to an upper yoke 79 and its lower end secured to a lower yoke 81. Lower yoke 81 is pivotally connected to an operating lever 83 that is part of the switch operating mechanism 71. In FIGS. 1 and 2 of the drawings, operating lever 83 is shown in its upper or closed switch position. Opening of the first set of contacts 15 is effected by operating lever 83 which turns in a clockwise direction (FIG. 1) and pulls operating rod 75 downwardly to thereby pivot actuating bar 49 outwardly and away from the insulated base 13. The pivotal movement of the bar 49 simultaneously pivots the movable contacts 23, 25 and 27 outwardly from fixed contacts 17, 19 and 21 and, thus, opens the first set of contacts. A connecting bar 89 extends between the actuating bars 49 of the first and second sets of contacts 15 so that both sets of contacts 15 are opened and closed simultaneously upon movement of the operator handle 73.

Transparent shields 93 are positioned in front of each set of switch contacts 15 on metal shields or partitions 95. The transparent shields extend downwardly below the closed positions of the switch actuator bars 49. The transparent shields are of the type described and claimed in U.S. Pat. No. 4,110,584.

Figure 4:
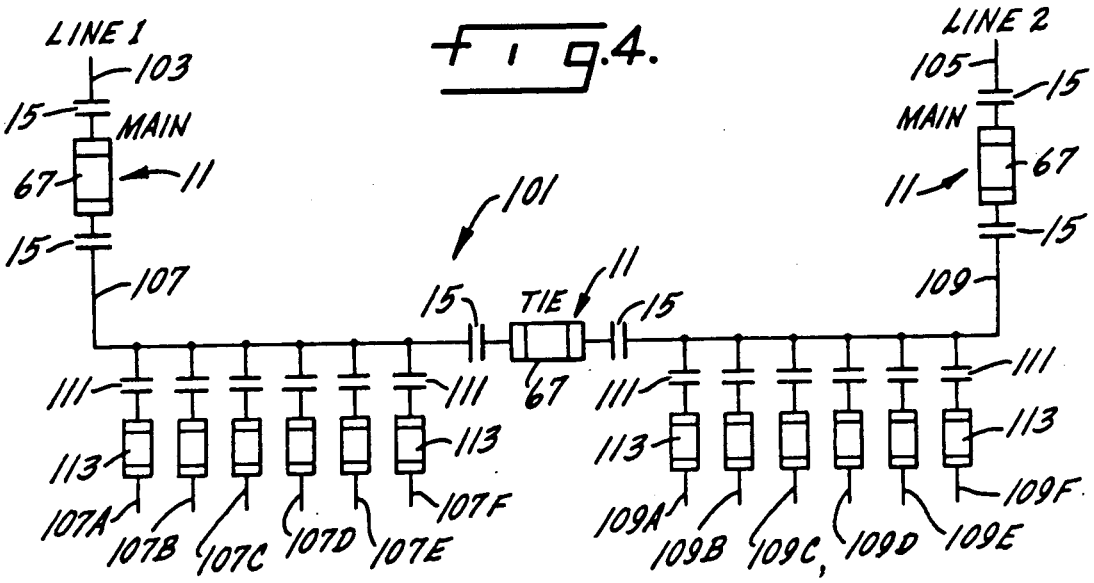
FIG. 4 is a schematic showing an electrical circuit using the switches of this invention in a double-ended switch board.

FIG. 4 of the drawings shows a circuit of the type installed in a hospital or other facility where continuity of electrical power is essential. The circuit 101 has power sources 103 and 105, each having sufficient capacity to supply the entire anticipated load. Each power source is controlled by a high current, low voltage load break switch 11 of the type hereintofore described in this specification. Each switch 11 includes contact sets 15 isolating a fuse 67. Each switch 11, in effect, under normal operating conditions, controls its leg 107 and 109, respectively, of the circuit 101. Branch circuits 107A, 107B, 107C, 107D, 107E, 107F are located on circuit leg 107 while branch circuits 109A, 109B, 109C, 109D, 109E, 109F are located on leg 109 of circuit 101. Each of the circuits is controlled by a conventional load break switch 111 and a fuse 113.

The legs 107 and 109 of the circuit 101 are tied together by a high current, low voltage load break switch 11 of the type described in this invention having contact sets 15 isolating its fuse 67. The switch 11 between the circuit legs 107 and 109 is normally open, isolating the legs 107 and 109 of the circuit 101 from each other so that each is supplied by its own power source 103 and 105, respectively. If one of the power sources 103 or 105 fails or must be shut off under normal circumstances, its switch 11 is opened and the switch 11 between the legs 107 and 109 of the circuit 101 is opened, thereby supplying all of the branch circuits 107A through 107F and 109A through 109F from one of the power sources. Since contact sets 15 are provided on each side of the fuse 67, it is possible to replace the fuse in each one of the switches 11 under cold conditions.

I claim:

1. A fused high current, low voltage load break pressure contact switch including:

a first set of contacts having a first fixed contact, a first movable contact movable between a closed position in bolted pressure contact with said first fixed contact and an open position displaced from said first fixed contact, a second set of contacts having a second fixed contact, a second movable contact movable between a closed position in bolted pressure contact with said second fixed contact and an open position displaced from said second fixed contact, a fuse holder located between said first and second sets of contacts, a switch operator mechanism having an operating lever, an operating rod connected to said operating lever and to said first set of contacts, and a connector lever extending between said first and second sets of contacts for movement of said second set of contacts in unison with the movement of said first set of contacts as controlled by said operating rod.

* * * * *